US005393581A

United States Patent [19]

Mares

[11] Patent Number: 5,393,581

[45] Date of Patent: Feb. 28, 1995

[54] READILY APPLIED AND REMOVED SHIELD FOR GRAPHITE SHAFTS

[76] Inventor: Milton H. Mares, 346 30th Ave., San Francisco, Calif. 94121

[21] Appl. No.: 206,029

[22] Filed: Mar. 3, 1994

Related U.S. Application Data

[63] Continuation of Ser. No. 811,263, Dec. 20, 1991, abandoned.

[51] Int. Cl.[6] ..... A63B 53/02

[52] U.S. Cl. ..... 428/34.1; 428/36.92; 273/162 F; 273/80 R; 273/80.5

[58] Field of Search ..... 428/34.1, 35.7, 36.5, 428/36.9, 36.92, 192; 138/156, 165, 110; 52/727, 728, 724, 725, 423, 244; 174/135, 136; 273/162 F, 80 R, 80.3, 80.5, 80.9

[56] References Cited

U.S. PATENT DOCUMENTS

| | | | |
|---|---|---|---|
| 2,908,744 | 5/1956 | Bollmeier | 174/76 |
| 3,620,258 | 11/1971 | Graham | 138/140 |
| 4,497,404 | 2/1985 | Lowrance | 206/315.2 |
| 4,615,337 | 10/1986 | Allinson | 52/728 |
| 4,967,799 | 11/1990 | Bradshaw et al. | 138/110 |
| 5,284,194 | 2/1994 | Gaffney | 150/160 |

*Primary Examiner*—Charles R. Nold

*Attorney, Agent, or Firm*—George B. Almeida

[57] ABSTRACT

A tubular member defining a shield is formed of a pliable yet resilient plastic split along one side of its length. The cross section of at least one end is selectively tapered to provide an extended end portion at the extreme end of the tapered cross section. The extended end portion facilitates the pressing of the split tubular member onto a selected length of a graphite shaft of a golf club, to prevent wear on the graphite shaft by the divider sections of a golf bag when the clubs are being carried in the bag.

8 Claims, 2 Drawing Sheets

READILY APPLIED AND REMOVED SHIELD FOR GRAPHITE SHAFTS

This is a continuation of application(s) Ser. No. 07/811,263, filed on Dec. 20, 1991, now abandoned.

The present invention relates to the protection of golf club shafts and the like, and particularly to a shield which readily is slipped over a golf club graphite shaft to protect the shaft from wear when carried in a golf bag.

BACKGROUND OF THE INVENTION

In the sport of golf, graphite shafts have become increasingly popular in the manufacture of golf clubs. Although graphite is predominantly found on metal wood clubs (woods), there is increasing utilization of graphite shafts on the iron clubs (irons) in a golf set. It appears that golfing purists continue to use the metal shafts on most of their golf clubs but these purists are vastly outnumbered by the average golfers who are enthralled with the promise that the graphite shafts, because of their resiliency and relatively lighter weight, allow golfers to produce more club head speed in their swing and therefore allow them to hit for greater distance.

Most golf bags contain at the top of the bag, a club divider formed of at least four club divider sections constructed of very durable plastic. When the metal woods or irons with graphite shafts are inserted in the bag they bear against their respective divider section at one point along the shaft of each club. When the bag is carried by the golfer, the metal woods as well as any graphite shaft irons, move back and forth against the club divider sections. This action tends to wear a groove in the shaft where it comes in contact with the divider plastic. That is, it has been found that there is decided deterioration of the graphite shaft due to the constant moving contact of the golf clubs against the club divider sections. Over a given period of time the graphite shaft may wear so thin at its contact point with the club divider that the graphite shaft may shatter upon contact with a golf ball.

Various golf bag manufacturers have started to manufacture and sell golf bags that utilize a fur-like material along the golf club divider sections of the golf bag, ostensibly in an effort to reduce the wear on the graphite shafts referred to above. However, while such a fur-lined club divider may reduce wear on a graphite shaft, it does require the purchase of a new golf bag at a cost of somewhere between $75.00 and $100.00 to obtain this protection for the graphite shafts.

Additionally, various golf club manufacturers (of, for example, metal wood clubs) sell their new woods with a head cover which extends further down the club to cover a longer length of the graphite shaft. This extended golf club cover provides some protection against wear on the graphite shaft but it is difficult to put on the club. In addition, once it is on the club, the club head cover has a tendency to bunch up when it snags against the club divider as the club is inserted back into the bag, whereby it no longer extends down into the bag to prevent contact between the shaft and the club divider. Thus, the long club head covers not only are expensive but are, to a large extent, ineffective.

SUMMARY OF THE INVENTION

The present invention overcomes the disadvantages of previous mention by providing a protective shield in the form of a removable sheath, which is completely effective in providing shaft protection, is easily attached to and detached from the graphite shaft, and is inexpensive. Basically, the shield is a tubular member made of a soft pliable plastic of the order of seven inches long. The tubular member is split along its length whereby it may be slipped over a selected length of the graphite shaft, to encase the shaft along that length. Because of the design, the material and the diameter of the tubular member, the shield formed thereby has a tendency to stick to the graphite shaft at the point where attached. The tubular member is specially formed with a tapered cross section at least at one end, so as to provide an extended end portion configuration, which end portion can be pressed against the shaft between a thumb and a forefinger, to initiate spreading the split tubular member to allow attaching the shield onto the graphite shaft. That is, the side of the tubular member which has the split is cut away at a selected angle to define the extended end portion at the side of the member which is diametrically opposite the split. Additionally, both ends of the member may be similarly formed which allows attaching the shield to a shaft with little or no effort starting at either end and without paying close attention.

DETAILED DESCRIPTION OF THE PREFERRED EMBODIMENTS

Utilization of the invention on the graphite shafts of any golf club will provide absolute protection against the damage caused to graphite shafts resulting from the shafts rubbing and bouncing against the conventional hard plastic club divider sections found in almost all present golf bags. The shield of the invention prevents contact between the graphite shaft and the club divider sections of the golf bag, whereby any resultant wear is to the protective shield only.

Figure 1:
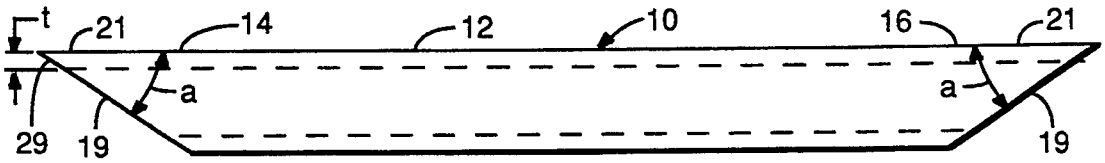
FIG. 1 is a plan view exemplifying one embodiment of the invention.
Figure 2:
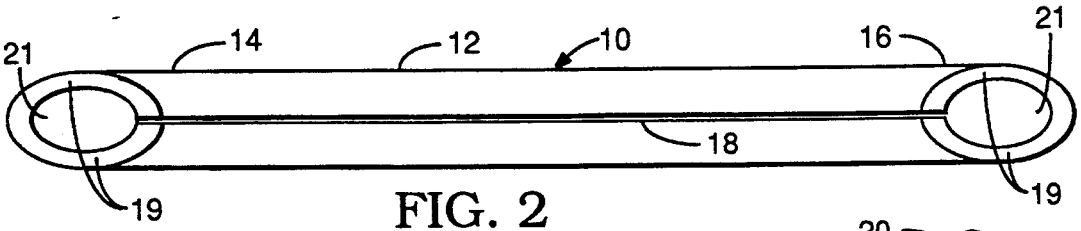
FIG. 2 is an elevation view of the embodiment of FIG. 1.
Figure 3:
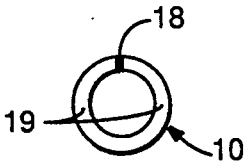
FIG. 3 is an end view of the embodiment of FIGS. 1 and 2.

Referring to FIGS. 1, 2 and 3, there is depicted a basic embodiment of the present shield comprising an elongated length of a tubular member 10 having a central portion 12 and terminating in a pair of opposing ends 14 and 16. The length of the tubular member is of the order of seven inches, however may be of any length sufficient to provide the protective shield along any length of a golf club shaft which may make contact with the golf bag divider sections. Thus, the length could be of the order of, for example, from four through ten inches if preferred. The preferred material for the tubular member 10 is a soft pliable plastic which not only retains its elasticity and resilience, but also tends to adhere to the shaft where attached. To this end, the tubular member 10 preferably has an inside diameter which is approximately the same as the shaft's outside diameter. By way of example only, in a preferred embodiment, the wall thickness of the tubular member 10 is of the order of one-eighth of an inch, and the inside diameter is of the order of 7/16 of an inch.

In accordance with the invention, the tubular member 10 is split along its shortest length, as depicted by numeral 18, to allow the member to be slipped onto a graphite shaft of a golf club. This process is enhanced by providing at least one end 14 (and preferably the opposite end 16) with a tapered cross section 19 relative to the axial length of the member 10, which end includes an extended end portion 21. That is, in a basic embodiment, the end 14, (and/or 16) is formed at a selected angle, a, which may be, by way of example only, of the order of from 20 through 45 degrees relative to the member's length. The extended end portion 21 facilitates attaching the shield to the shaft as further described below.

Figure 6:
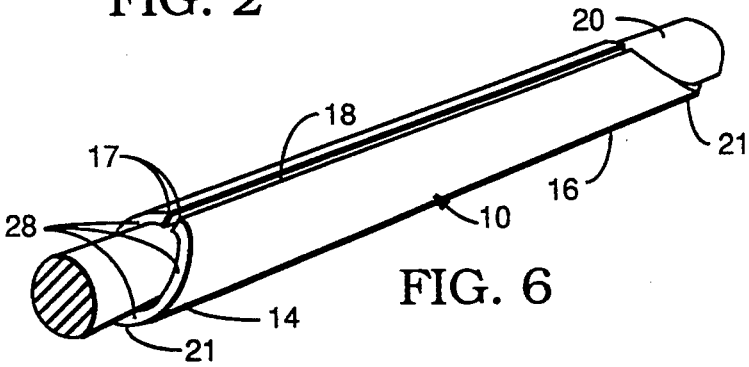
FIG. 6 is a perspective view of the shield of the invention attached to a shaft.
Figure 4:
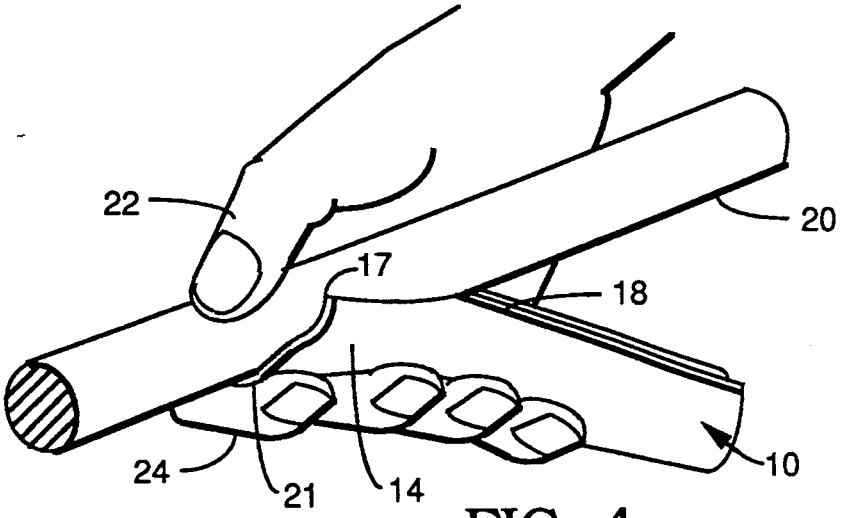
FIGS. 4 and 5 are perspective views illustrating the technique for attaching the invention to the shaft of a golf club, as facilitated by the extended end portion configuration of the invention.
Figure 5:
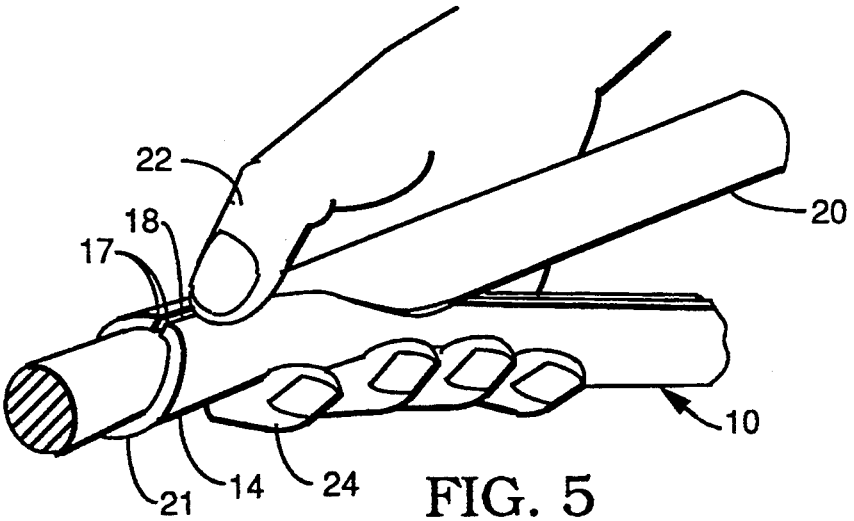

To this end, as depicted in FIGS. 4 and 5, the tubular member 10 is attached to a shaft 20 of a club by holding the member 10 in the palm of a hand, preferably with a thumb 22 placed on top of the shaft 20, and with the forefinger 24 of the same hand under the tubular member in the region of the extended end portion 21 of the end 14 (or 16). That is, the length of the shaft 20 which is to be protected is placed under the thumb 22 and the shaft is placed on top of the split 18 in the member 10. The forefinger 24 is placed on the extended end portion 21, whereby the forefinger presses the extended end portion upwardly flat against the shaft. The resulting pressure against the extended end portion 21 tends to force the remaining tapered surfaces of the slanted cross section of end 14, and particularly the facing ends 17 of the split 18, about the shaft 20. Thereafter, in a continuous motion, the confining thumb and forefinger are moved down the length of the member 10 and shaft 20 while continuing to press the member with the fingers upwardly onto the shaft as the hand moves along the member, as depicted in FIG. 5. Once attached, the tubular member 10 clings snugly to the graphite shaft even when treated roughly. When the club is placed in the bag, the shield protects the shaft from wear by preventing contact between it and the golf bag divider sections. FIG. 6 depicts the shield as it appears after being attached to a portion of the shaft 20 of a club.

At such time as the club is to be used, the tubular member 10 is removed simply by grasping an end 14 or 16 between the thumb and fingers and pulling the member from the shaft 20 via the split 18.

Figure 7:
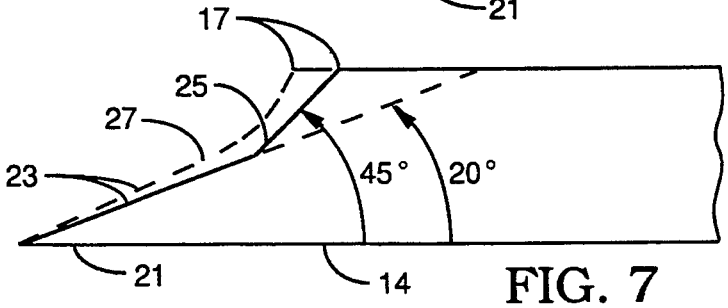
FIG. 7 is an enlarged elevation view of an embodiment of the invention illustrating a preferred extended end portion configuration of the invention.

FIG. 7 illustrates in further detail the end 14 (or 16), and particularly the extended end portion 21 which facilitates the attachment of the shield of the invention to a graphite shaft of a golf club or the like. The embodiment of FIGS. 1–3 depicts the tapered cross section 19 with a generally constant selected angle, a, of the order of 30 degrees relative to the length of the tubular member 10. However, as shown in FIG. 7, the taper formed in ends 14 or 16 does not have to be constant, but preferably may be varied either abruptly in a step or steps or gradually in a continuous curve, to provide an extended end portion 21 such as previously mentioned wherein, however, the end portion is more pronounced and flattened as illustrated in FIG. 7 as extended end portion 23. The flattened extended end portion 23 further facilitates attaching the shield since it allows the user to firmly press the extended end portion 23 against the shaft 20 with the thumb and forefinger, and thereby force the facing split ends 17 (FIGS. 4, 5) of the split 18 to spread to encase the shaft in response to further pressure upwardly by the fingers. As mentioned, the graduated cross section of FIG. 7 may be an abrupt step as illustrated by numeral 25 wherein angle, a, changes, for example, from 20 degrees to 45 degrees. Alternately, the tapered cross section may have a gradual curved change as illustrated by numeral 27. The degree of taper and the configuration of the tapered cross section 19 is a matter of choice depending upon the application, fabricating techniques, etc, and accordingly is not intended to be limited to the specific examples depicted herein.

Figure 8:
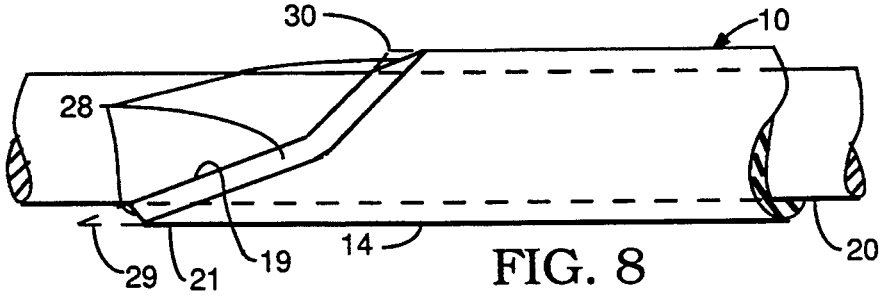
FIG. 8 is an enlarged elevation view of an alternative embodiment of the invention illustrating a back-beveled extended end portion configuration, which prevents the shield from snagging the club divider when the club is inserted into a golf bag.

FIG. 8 illustrates a modification to the various embodiments of the invention wherein the cross section of the end 14 (and/or 16) which defines a tapered annular surface, is back beveled along preferably its entire periphery, such as illustrated at 28, to remove the radially extending ridge which inherently is formed when the tapered cross section of the end of the member is fabricated. See, for example, the pointed ridge 29 formed by the tapered cross section 19 in FIG. 1 due to the thickness, t, of the tubular member wall. The pointed ridge 29 is also depicted in dotted lines at 29 and 30 in FIG. 8. The back beveled periphery 28 of the member 10, when the member is attached to the shaft 20, prevents the shield from snagging a divider section as the club is inserted in the bag. Accordingly, it is preferable to back bevel any of the embodiments illustrated by way of example in the FIGS. 1–7, either partially as at the very tip of the extended end portion 21 (or 23) or around the entire periphery as shown in FIG. 8.

The shield may be left on the club shaft until the club is needed. In any event, the shield will cling to the shaft while the club is swung, but it is neither desirable nor practical to leave the shield on the club while the club is being used.

Although the shield of the invention is described herein with respect to a graphite shaft of a golf club, the invention contemplates use with any shaft material and/or with the shaft, rod, etc, of any other similar or equivalent apparatus which may experience wear. Thus, these and additional features and advantages will be apparent from the description and drawings herein, whereby the scope of the invention is defined by the following claims and their equivalents.

I claim:

1. A golf club shaft shield for protecting a golf club shaft, which shield includes an end portion configuration which initiates the ready attachment of the shield to and from the shaft, comprising:

an elongate tubular member terminating in opposing ends and having a centrally extending axis, a generally circular cross section and an overall length;

at least one of said ends being formed into a tapered end means, said tapered end means having a taper formed at a preselected angle relative to said axis to terminate said tapered end means in an extended tip;

wherein an axial line coincident with the extended tip of said tapered end means further defines said overall length;

said elongate tubular member having a shortest length coaxial with and in generally diametrically opposed relation to, the axial line of the member;

said elongate tubular member being split axially along said shortest length; and said extended tip of the tapered end means providing for initiating the spreading of the split in the tubular member to facilitate slipping said shortest length thereof over the shaft to provide said ready attachment of the shield to the shaft.

2. The shield of claim 1 wherein the tapered end means includes a generally elliptical annular surface and terminates in said extended tip of the member to define a generally flattened extended end portion.

3. The shield of claim 2 wherein the inside diameter of the tubular member is of a diameter which causes it to fit snuggly about the shaft when installed.

4. The shield of claim 2 wherein the tubular member is formed of a pliable yet resilient plastic.

5. The shield of claim 2 wherein both ends of the tubular member are formed at the preselected angle to define opposing tapered end means, said split being formed axially along the member's shortest length to be generally diametrically opposite to said longitudinal line of the member.

6. The shield of claim 2 wherein the tapered end means comprises a tapered end of gradually increasing angle towards the extended tip, said angle being of the order of from 20 degrees through 45 degrees relative to the axis of the member.

7. The shield of claim 2 wherein the tapered end means comprises a tapered end of at least two angles relative to the axis, wherein the flattened extended end portion has a smaller angle of taper relative to the axis of the member than a remaining tapered portion.

8. The shield of claim 2 wherein the tubular member has a selected wall thickness and the tapered end means includes a tapered end having a tapered annular surface of generally said selected wall thickness, said wall thickness being selectively back-beveled to lessen the ridge formed by the wall thickness.

* * * * *